US008525616B1

(12) United States Patent
Shaw et al.

(10) Patent No.: US 8,525,616 B1
(45) Date of Patent: Sep. 3, 2013

(54) ANTENNA FEED NETWORK TO PRODUCE BOTH LINEAR AND CIRCULAR POLARIZATIONS

(75) Inventors: Robert K. Shaw, Willow Grove, PA (US); Jonathan P. MacGahan, Ivyland, PA (US); Sulinder S. Dhanjal, Pennington, NJ (US); Erik Lier, Newtown, PA (US); Bernard F. Lindinger, Elkins Park, PA (US); James W. Matthews, Doylestown, PA (US); Kanti N. Patel, Newtown, PA (US)

(73) Assignee: Lockheed Martin Corporation, Bethesda, MA (US)

( * ) Notice: Subject to any disclaimer, the term of this patent is extended or adjusted under 35 U.S.C. 154(b) by 674 days.

(21) Appl. No.: 12/758,429

(22) Filed: Apr. 12, 2010

Related U.S. Application Data

(60) Provisional application No. 61/169,262, filed on Apr. 14, 2009.

(51) Int. Cl.
*H01P 5/12* (2006.01)

(52) U.S. Cl.
USPC ..... 333/135; 333/126; 333/129

(58) Field of Classification Search
USPC ..... 333/124–129, 133, 135
See application file for complete search history.

(56) References Cited

U.S. PATENT DOCUMENTS

| | | | | |
|---|---|---|---|---|
| 4,308,541 | A * | 12/1981 | Frosch et al. | 343/786 |
| 5,061,037 | A * | 10/1991 | Wong et al. | 385/11 |
| 5,305,001 | A * | 4/1994 | Wong et al. | 343/786 |
| 6,225,875 | B1 * | 5/2001 | Kich | 333/125 |
| 6,388,537 | B1 * | 5/2002 | Matsumoto | 333/21 A |
| 6,563,470 | B2 * | 5/2003 | Wilson et al. | 343/756 |
| 6,839,037 | B1 | 1/2005 | Stokes | |
| 6,839,543 | B1 | 1/2005 | Chen | |
| 7,511,678 | B2 * | 3/2009 | Wu | 343/786 |

* cited by examiner

*Primary Examiner* — Robert Pascal
*Assistant Examiner* — Kimberly Glenn
(74) *Attorney, Agent, or Firm* — Fraser Clemens Martin & Miller LLC; J. Douglas Miller

(57) ABSTRACT

An antenna feed network includes a septum polarizer including a waveguide defining a cavity, wherein a septum is disposed in the cavity to divide the cavity to form a first port and as second port, a diplexer in signal communication with at least one of the first port and the second port of the septum polarizer to route a signal based upon a frequency, and a wave coupler/splitter in signal communication with the diplexer to send and receive signals therebetween, the wave coupler/splitter including a first signal path and a second signal path, wherein the wave coupler/splitter controls a phase shift of a signal transmitted through at least one of the first signal path and the second signal path.

19 Claims, 11 Drawing Sheets

ANTENNA FEED NETWORK TO PRODUCE BOTH LINEAR AND CIRCULAR POLARIZATIONS

CROSS-REFERENCE TO RELATED APPLICATIONS

The present application claims priority to U.S. Provisional Application Ser. No. 61/169,262 filed Apr. 14, 2009.

STATEMENT REGARDING FEDERALLY SPONSORED RESEARCH OR DEVELOPMENT

Not applicable.

FIELD OF THE INVENTION

The present invention relates generally to an antenna. More particularly, the invention is directed to an antenna feed network for producing both linear and circular polarizations.

BACKGROUND OF THE INVENTION

Typically satellite antenna feeds are either circularly polarized or linearly polarized. However, some satellite antennas require a combination of linear and circular polarization. In applications that require both linear and circular polarization, standard feed design no longer meets customer requirements, and a novel configuration is needed to satisfy customer polarization diversity requirements at low risk.

Currently, antenna feeds split a received signal into two orthogonal linear components. Each of the orthogonal linear components is further separated based upon two pre-determined frequency bands. Finally, the band requiring circular polarization is created by adding the two linear components 90 degrees out of phase. For example, two conventional methods are described below:

In a first method, a signal is split into a horizontal and a vertical polarizations (Hpol and Vpol) using a turnstile junction and a pair of magic-T wave guides. The Hpol and Vpol are passed into the common port of a pair of diplexers, respectively. Two orthogonal linear polarizations are each received at a receive port of each of the diplexers, respectively. In transmission, each of the transmit ports of the diplexers must be summed 90 degrees out of phase to produce the circularly polarized transmit port by letting one polarization pass through one quarter wavelength more of waveguide and adding them using a magic-T.

In a second method, a six-port device separates the orthogonal linear components and frequency bands simultaneously. In the six-port configuration, the circularly polarized band, either transmit or receive, passes straight through the six-port device, and a filter is used to remove a pre-determined band from the signal. A polarizer can then be used to obtain dual-polarization circular polarization in the pre-determined band. Four ports on the walls of the 6-port device receive components of the linear polarized frequency band. Each opposite pair of the four ports receives one orthogonal polarization, and each pair is combined using a magic-T.

It would be desirable to develop an antenna feed network that provides a compact and lightweight solution to an application requiring the capability of both linear and circular polarization.

SUMMARY OF THE INVENTION

Concordant and consistent with the present invention, an antenna feed network that provides a compact and lightweight solution to an application requiring the capability of both linear and circular polarization, has surprisingly been discovered.

In one embodiment, an antenna feed network comprises: a septum polarizer including a waveguide defining a cavity, wherein a septum is disposed in the cavity to divide the cavity to form a first port and a second port; a diplexer in signal communication with at least one of the first port and the second port of the septum polarizer to route a signal based upon a frequency; and a wave coupler/splitter in signal communication with the diplexer to send and receive signals therebetween, the wave coupler/splitter including a first signal path and a second signal path, wherein the wave coupler/splitter controls a phase shift of a signal transmitted through at least one of the first signal path and the second signal path.

In another embodiment, an antenna feed network comprises: a septum polarizer including a waveguide defining a cavity, wherein a septum is disposed in the cavity to divide the cavity to form a first port and a second port; a first diplexer in signal communication with the first port of the septum polarizer to route a signal based upon a frequency; a second diplexer in signal communication with the second port of the septum polarizer to route a signal based upon a frequency; and a wave coupler/splitter in signal communication with the diplexer to send and receive signals therebetween, the wave coupler/splitter including a first signal path and a second signal path, wherein the wave coupler/splitter controls a phase shift of a signal transmitted through at least one of the first signal path and the second signal path.

In another embodiment, an antenna feed network comprises: a septum polarizer including a waveguide defining a cavity, wherein a septum is disposed in the cavity to divide the cavity to form a first port and as second port; a first diplexer including a common port in signal communication with the first port of the septum polarizer to route a signal based upon a frequency, wherein first diplexer further includes a first polarizer port having a first pre-determined passband frequency and a second polarizer port having a second pre-determined passband frequency, each of the first polarizer port and the second polarizer port of the first diplexer in signal communication with the first port of the septum polarizer; a second diplexer including a common port in signal communication with the second port of the septum polarizer to route a signal based upon a frequency, wherein second diplexer further includes a first polarizer port having a first pre-determined passband frequency and a second polarizer port having a second pre-determined passband frequency, each of the first polarizer port and the second polarizer port of the second diplexer in signal communication with the second port of the septum polarizer; and a wave coupler/splitter in signal communication with the diplexer to send and receive signals therebetween, the wave coupler/splitter including a first signal path and a second signal path, wherein the wave coupler/splitter controls a phase shift of a signal transmitted through at least one of the first signal path and the second signal path.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner.

Figure 1:
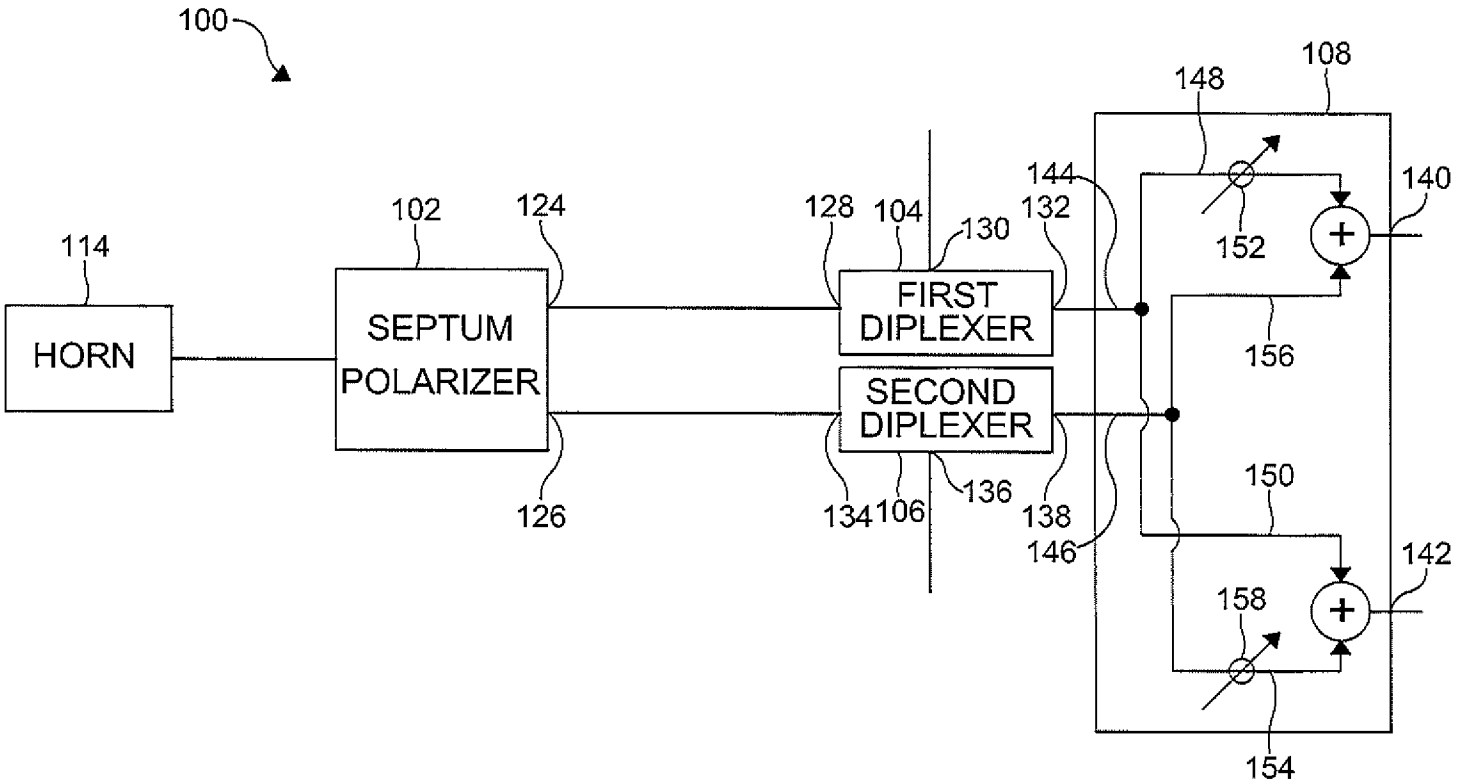
FIG. 1 is a schematic diagram of an antenna feed network according to an embodiment of the present invention.
Figure 2:
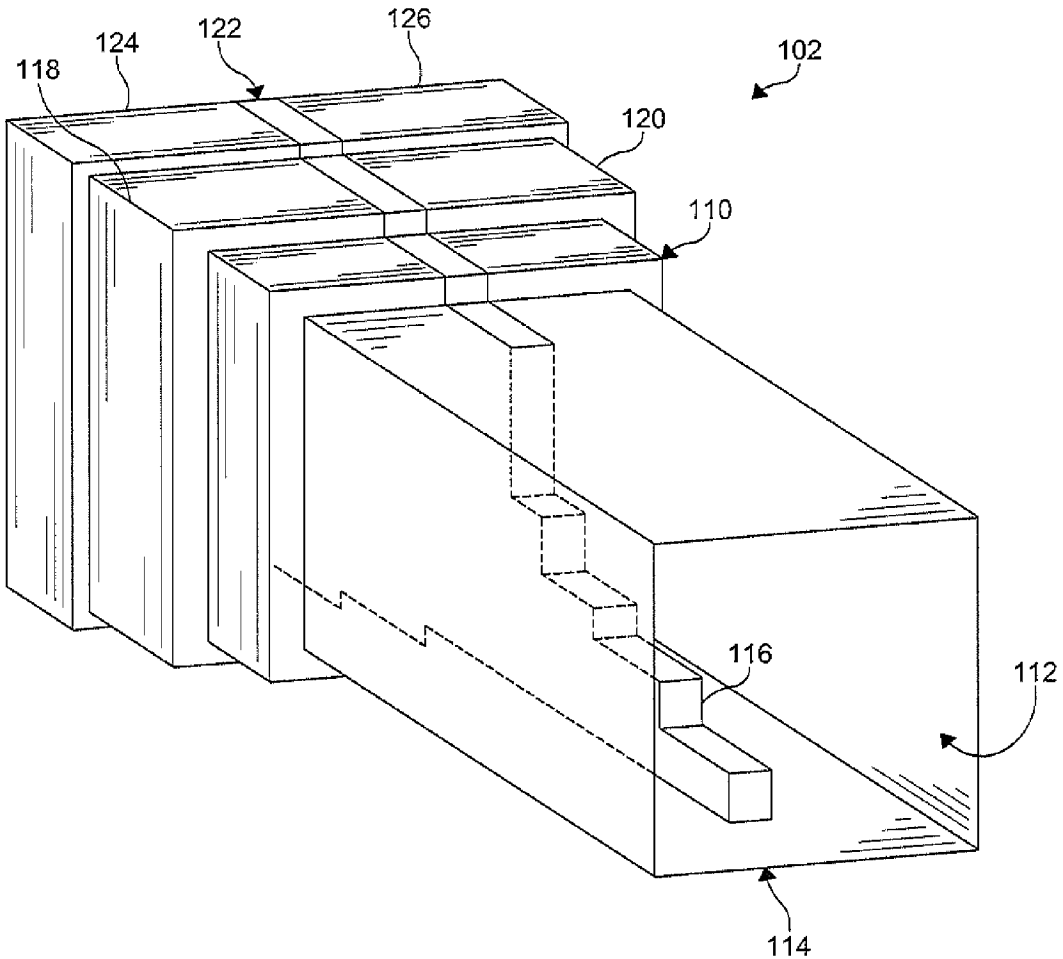
FIG. 2 is a front perspective view of a three dimensional schematic model of a septum polarizer of the antenna feed network of FIG. 1.

FIGS. 1-2 illustrate an antenna feed network 100 according to an embodiment of the present invention. As shown, the network 100 includes a septum polarizer 102, a pair of diplexers 104, 106, and a wave coupler/splitter 108.

The septum polarizer 102 includes a wave guide 110 defining a cavity 112 therein. As shown, the waveguide 110 is a tapered waveguide. However, the waveguide 110 can have any shape, flare, and dimensions including a predetermined axial ratio in a circular polarization band. It is understood that an axial ratio requirement in the linear polarization band can be relaxed.

The waveguide 110 of the septum polarizer 102 includes a horn end 114 to receive and radiate electromagnetic waves in a desired direction. As a non-limiting example, the horn end 114 is an open end. However, the horn end 114 can be enclosed. As further a non-limiting example, the horn end 114 is un-flared and has a substantially square shaped cross-section. It is understood that the wave guide 110 may have one or more expansion curves, i.e. longitudinal cross sections such as elliptical, conical, hyperbolic, or parabolic curves, and not necessarily the same expansion curve in each cross section (i.e. E-plane and H-plane). It is further understood that a wide range of beam patterns may be formed by controlling the dimensions and shape of the waveguide 110, as well as a shape and placement of a reflector (not shown) and a choke (not shown), for example.

A septum 116 is disposed in the cavity 112 to split a portion of the cavity 112 into a first waveguide portion 118 and a second waveguide portion 120. As shown, the septum 116 is a wall having a stepped configuration to generate circular polarization as can be appreciated by one skilled in the art of antenna feed networks. However, other configurations and shapes can be used. It is understood that the septum 116 can be a gap or stepped channel formed in the waveguide 110 to split a portion of the cavity 112 into the first waveguide portion 118 and the second waveguide portion 120.

In the embodiment shown, the septum 116 extends along a center line of the waveguide 110 and bisects a back end 122 of the waveguide 110 opposite the horn end 114 to form two ports 124, 126. Each of the ports 124, 126 is disposed on a respective side of the septum wall 116 and has a generally rectangular shape. As a non-limiting example, the first port 124 is in signal communication with the first waveguide portion 118 and the second port 126 is in signal communication with the second waveguide portion 120. It is understood that any number of the ports 124, 126 can be used. It is further understood that the ports 124, 126 can have any shape, size and orientation.

The first diplexer 104 includes a common port 128, a first polarizer port 130, and a second polarizer port 132. As shown, the common port 128 is in signal communication with the first port 124 of the septum polarizer 102 for intercommunication of signals therebetween. The first polarizer port 130 has a pre-determined passband frequency and is typically associated with circular polarization. The second polarizer port 132 is in signal communication with the wave coupler/splitter 108. The second polarizer port 132 has a pre-determined passband frequency that is typically different than a bandwidth associated with the first polarizer port 130. It is understood that any passband frequency can be associated with the ports 130, 132. It is further understood that any diplexer can be used such as a waveguide diplexer known in the art.

The second diplexer 106 includes a common port 134, a first polarizer port 136, and a second polarizer port 138. As shown, the common port 134 is in signal communication with the second port 126 of the septum polarizer 102 for intercommunication of signals therebetween. The first polarizer port 136 has a pre-determined passband frequency and is typically associated with circular polarization. The second polarizer port 138 is in signal communication with the wave coupler/splitter 108. The second polarizer port 138 has a pre-determined passband frequency that is typically different than a bandwidth associated with the first polarizer port 136. It is understood that any passband frequency can be associated with the ports 136, 138. It is further understood that any diplexer can be used such as a waveguide diplexer known in the art.

The wave coupler/splitter 108 includes a first signal port 140, a second signal port 142, a first signal path 144, and a second signal path 146. As shown, the first signal path 144 is in signal communication with the second polarizer port 132 of the first diplexer 104. The first signal path 144 is split into a phase shift portion 148 and a non-shift portion 150, wherein a variable phase shifter 152 is in signal communication with the phase shift portion 148 of the first signal path 144 to control a phase shift of a signal transmitted therethrough. It is understood that the phase shifting can be accomplished using other wave coupler configurations such as a magic-T, a branch line coupler, and the like, for example.

The second signal path 146 is in signal communication with the second port 138 of the second diplexer 106. The second signal path 146 is split into a phase shift portion 154 and a non-shift portion 156, wherein a variable phase shifter 158 is in signal communication with the phase shift portion 154 of the second signal path 146 to control a phase shift of a signal transmitted therethrough.

In use, a signal is received at the horn end 114 of the waveguide 110 and the septum 116 splits the signal into a left-hand circular polarization (LHCP) component and right-hand circular polarization (RHCP) component. As a non-limiting example, the RHCP component of the signal is received at the port 124 and the LHCP component of the signal is received at the port 126. Each of the ports 124, 126 routes a received component of the signal to the respective common ports 128, 134 of the diplexers 104, 106. Each of the diplexers 104, 106 routes a received component of the signal to at least one of the polarizer ports 130, 132, 136, 138 based on a frequency of the received signal. In certain embodiments, at least a portion of the signal is routed to the wave coupler/splitter 108 through at least one of the second polarizer ports 132, 138 of at least one of the diplexers 104, 106.

A signal transmitted through the first signal path 144 of the wave coupler/splitter 108 is divided and transmitted through the phase shift portion 148 and the non-shift portion 150. Likewise, a signal transmitted through the second signal path 146 of the wave coupler/splitter 108 is divided and transmitted through the phase shift portion 154 and the non-shift portion 156.

The phase shift portion 148 of the first signal path 144 is coupled to the non-shift portion 156 of the second signal path 146 and a combined signal is routed to the first signal port 140. The phase shift portion 154 of the second signal path 146 is coupled to the non-shift portion 150 of the first signal path 144 and a combined signal is routed to the second signal port 142. It is understood that relative setting of the phase shifters 152, 158 determines the polarization of the combined signal received at the signal ports 140, 142.

In certain embodiments, the phase shifters 152, 158 are 180 degrees out of phase and the signal ports 140, 142 are linearly polarized, the polarization of each of the single ports 140, 142 orthogonal to the other. It is understood that the phase shifters 152, 158 can be modified to provide various linear polarizations at the signal ports 140, 142. It is further understood that the antenna feed network 100 can be used to transmit polarized signals.

As a non-limiting example, the first polarizer ports 130, 136 of each of the diplexers 104, 106 can be selectively fed with a signal to transmit a RHCP signal and a LHCP signal at the horn end 114. As a further non-limiting example, each of the signal ports 140, 142 of the wave coupler/splitter 108 can be selectively fed with a signal to transmit a linear polarized signal at the horn end 114. It is understood that relative setting of the phase shifters 152, 158 determines the polarization of a transmitted signal at the horn end 114. As a non-limiting example, where the phase shifters 152, 158 are configured to feed each of the ports 124, 126 of the septum polarizer 102 with in-phase signals having equal amplitude, the transmitted signal at the horn end 114 is horizontally polarized. As a further non-limiting example, where the phase shifters 152, 158 are configured to feed each of the ports 124, 126 of the septum polarizer 102 with signals having equal amplitude and 180 degrees out-of-phase, the transmitted signal at the horn end 114 is vertically polarized. As a further non-limiting example, where the phase shifters 152, 158 are configured to feed each of the ports 124, 126 of the septum polarizer 102 with signals having equal amplitude and 90 degrees out-of-phase, the transmitted signal at the horn end 114 is polarized at 45 degrees from vertical rotated toward one of the ports 124, 126 having the leading signal. It is understood that other configurations can be used to generate various linear and circular polarizations for receiving and transmitting signals.

Figure 3:
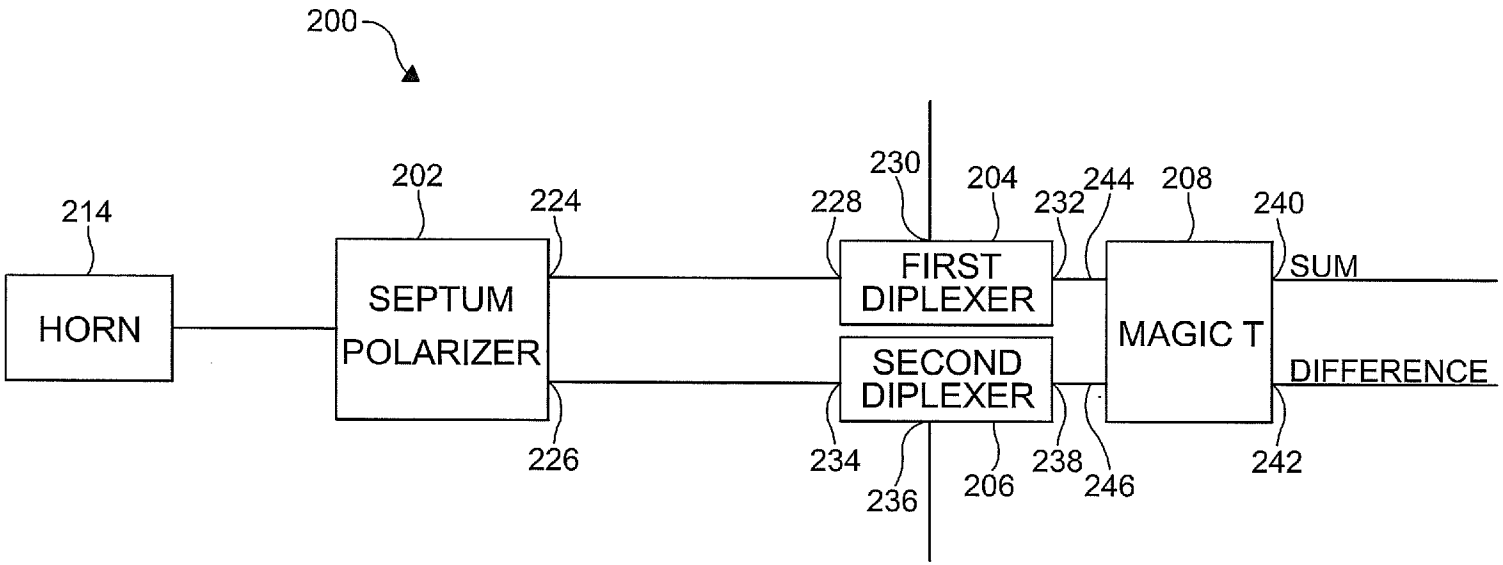
FIG. 3 is a schematic diagram of an antenna feed network according to another embodiment of the present invention.

FIG. 3 illustrates an antenna feed network 200 according to an embodiment of the present invention similar to the network 100 except as described herein below. As shown, the network 200 includes a septum polarizer 202, a pair of diplexers 204, 206, and a wave coupler/splitter 208.

Figure 4:
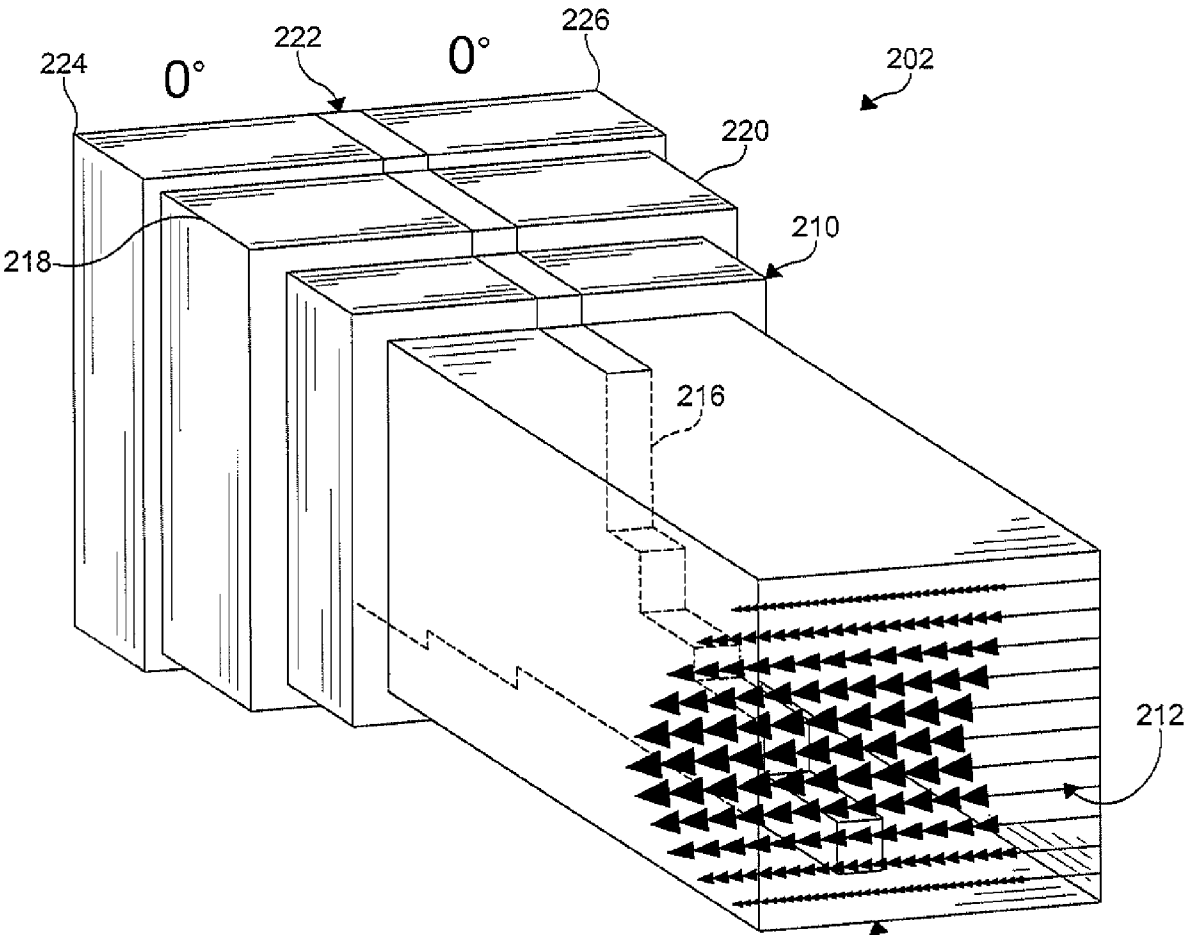
FIG. 4 is a front perspective view of a three dimensional schematic model of a septum polarizer of the antenna feed network of FIG. 3, showing a polarization pattern at a horn of the septum polarizer.
Figure 5:
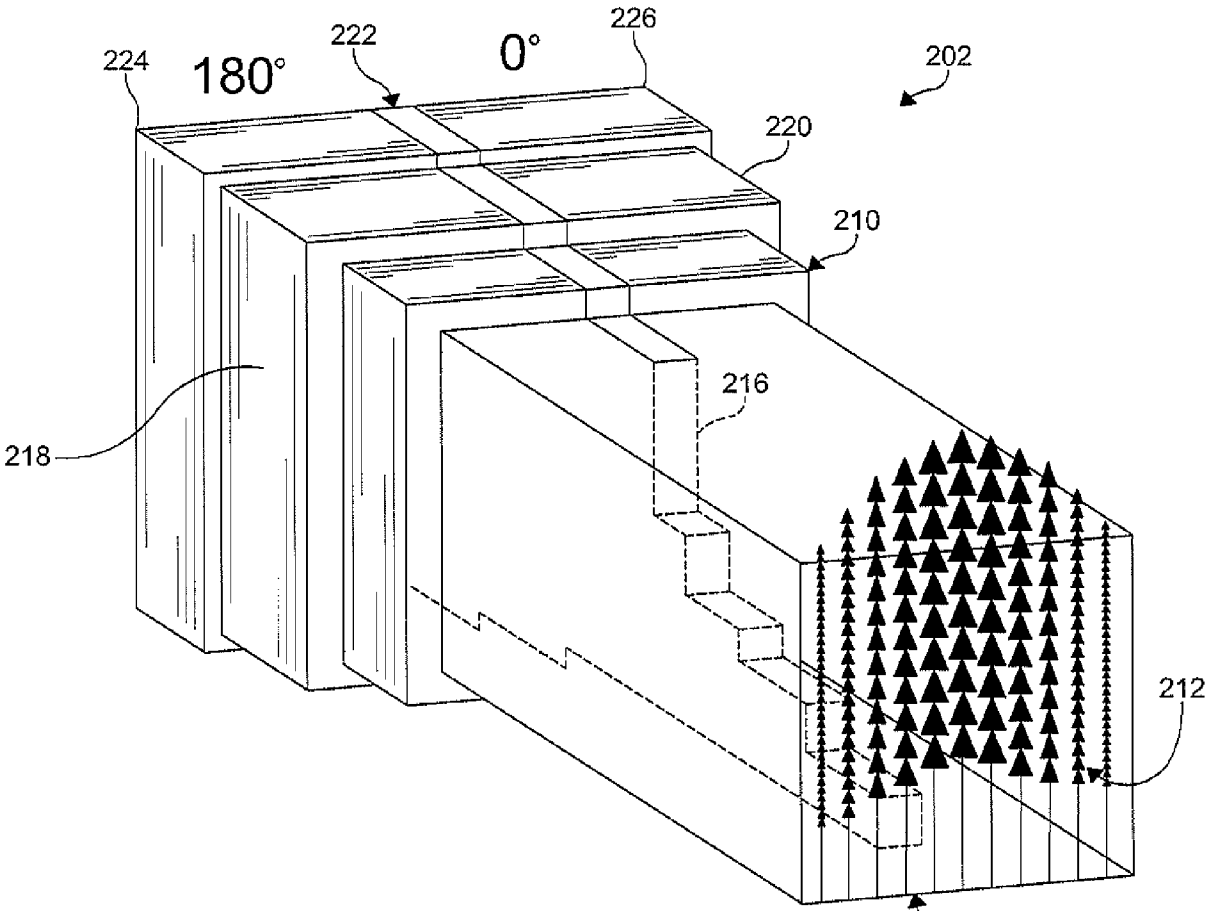
FIG. 5 is a front perspective view of a three dimensional schematic model of a septum polarizer of the antenna feed network of FIG. 3, showing a polarization pattern at a horn of the septum polarizer.

The septum polarizer 202 includes a wave guide 210 defining a cavity 212 therein, as shown in FIGS. 4 and 5. As shown, the waveguide 210 is a tapered waveguide. However, the waveguide 210 can have any shape, flare, and dimensions. The waveguide 210 includes a horn end 214 to receive and radiate electromagnetic waves in a desired direction. As a non-limiting example, the horn end 214 is an open end. However, the horn end 214 can be enclosed. As further a non-limiting example, the horn end 214 is un-flared and has a substantially square shaped cross-section. It is understood that the wave guide 210 may have one or more expansion curves, i.e. longitudinal cross sections such as elliptical, conical, hyperbolic, or parabolic curves, and not necessarily the same expansion curve in each cross section (i.e. E-plane and H-plane). It is further understood that a wide range of beam patterns may be formed by controlling the dimensions and shape of the waveguide 210, as well as a shape and placement of a reflector (not shown) and a choke (not shown), for example.

A septum 216 is disposed in the cavity 212 to split a portion of the cavity 212 into a first waveguide portion 218 and a second waveguide portion 220. As shown, the septum 216 has a stepped configuration to generate circular polarization as can be appreciated by one skilled in the art of antenna feed networks. However, other configurations and shapes can be used.

In the embodiment shown, the septum 216 extends along a center line of the waveguide 210 and bisects a back end 222 of the waveguide 210 opposite the horn end 214 to form two ports 224, 226. As a non-limiting example, the ports 224, 226 can have any size and shape and can be substantially the same or different. Each of the ports 224, 226 is disposed on a respective side of the septum 216 and has a generally rectangular shape. As a non-limiting example, the first port 224 is in signal communication with the first waveguide portion 218 and the second port 226 is in signal communication with the second waveguide portion 220. It is understood that any number of the ports 224, 226 can be used. It is further understood that the ports 224, 226 can have any shape, size and orientation.

The first diplexer 204 includes a common port 228, a first polarizer port 230, and a second polarizer port 232. As shown, the common port 228 is in signal communication with the first port 224 of the septum polarizer 202 for intercommunication of signals therebetween. The first polarizer port 230 has a pre-determined passband frequency and is typically associated with circular polarization. The second polarizer port 232 is in signal communication with the wave coupler/splitter 208. The second polarizer port 232 has a pre-determined passband frequency that is typically different than a bandwidth associated with the first polarizer port 230. It is understood that any passband frequency can be associated with the ports 230, 232. It is further understood that any diplexer can be used such as a waveguide diplexer known in the art.

The second diplexer 206 includes a common port 234, a first polarizer port 236, and a second polarizer port 238. As shown, the common port 234 is in signal communication with the second port 226 of the septum polarizer 202 for intercommunication of signals therebetween. The first polarizer port 236 has a pre-determined passband frequency and is typically associated with circular polarization. The second polarizer port 238 is in signal communication with the wave coupler/splitter 208. The second polarizer port 238 has a pre-determined passband frequency that is typically different than a bandwidth associated with the first polarizer port 236. It is understood that any passband frequency can be associated with the ports 236, 238. It is further understood that any diplexer can be used such as a waveguide diplexer known in the art.

The wave coupler/splitter 208 is a magic-T waveguide having a first signal port 240, a second signal port 242, a first signal path 244, and a second signal path 246. As a non-limiting example, the first signal port 240 is a sum port, wherein a signal incident on the first signal port 240 splits equally between the first signal path 244 and the second signal path 246 with the resulting split signals being in phase. As a further non-limiting example, the second signal port 242 is a delta port or a difference port, wherein a signal incident on the second signal port 242 splits equally between the first signal path 244 and the second signal path 246 with the resulting split signals being 180 degrees out of phase. It is understood that other arrangements of the ports 240, 242 can be made. It is further understood that other waveguide coupler/splitters can be used to function as the wave coupler/splitter 208, as appreciated by one skilled din the art of waveguides.

As shown, the first signal path 244 is in signal communication with the second polarizer port 232 of the first diplexer 204. The second signal path 246 is in signal communication with the second port 238 of the second diplexer 206. However, any signal routing configuration can be used.

In use, a signal is received at the horn end 214 of the waveguide 210 and the septum 216 splits the signal into a left-hand circular polarization (LHCP) component and right-hand circular polarization (RHCP) component. As a non-limiting example, the RHCP component of the signal is received at the port 224 and the LHCP component of the signal is received at the port 226. Each of the ports 224, 226 routes a received component of the signal to the respective common ports 228, 234 of the diplexers 204, 206. Each of the diplexers 204, 206 routes a received component of the signal to at least one of the polarizer ports 230, 232, 236, 238 based on a frequency of the received signal. In certain embodiments, at least a portion of the signal is routed to the wave coupler/splitter 208 through at least one of the second polarizer ports 232, 238 of at least one of the diplexers 204, 206.

In certain embodiments, a linear polarized signal received at the horn end 214 is passed through at least one of the second polarizer ports 232, 238 of at least one of the diplexers 204, 206 based upon a pre-determined linear polarization bandwidth. As a non-limiting example, the signal ports 240, 242 are linearly polarized, the polarization of each of the signal ports 240, 242 orthogonal to the other.

The antenna feed network 200 can be used to transmit polarized signals. As a non-limiting example, the first polarizer ports 230, 236 of each of the diplexers 204, 206 can be selectively fed with a signal to transmit a RHCP signal and a LHCP signal at the horn end 214. As a further non-limiting example, each of the signal ports 240, 242 of the wave coupler/splitter 208 can be selectively fed with a signal to transmit a linear polarized signal at the horn end 214. As more clearly shown in FIG. 4, where the first signal port 240 (i.e. sum port) of the wave coupler/splitter 208 is fed with a signal, the transmitted signal at the horn end 214 is horizontally polarized. As more clearly shown in FIG. 5, where the second signal port 242 (i.e. delta port, difference port) of the wave coupler/splitter 208 is fed with a signal, the transmitted signal at the horn end 214 is vertically polarized. It is understood that in certain embodiments, during transmit or receive, a polarization purity of a linear signal remains constant even if a frequency operation is outside an axial ratio bandwidth of the septum polarizer 202.

Figure 6:
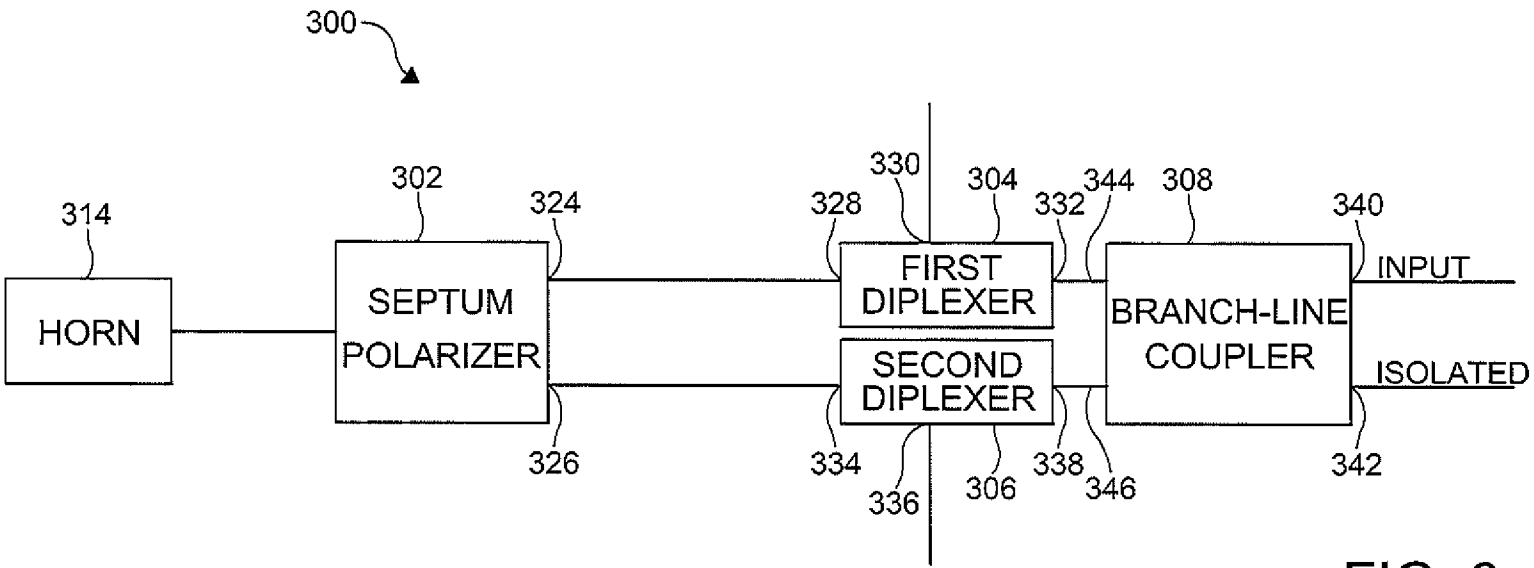
FIG. 6 is a schematic diagram of an antenna feed network according to another embodiment of the present invention.

FIG. 6 illustrates an antenna feed network 300 according to an embodiment of the present invention similar to the network 100 except as described herein below. As shown, the network 100 includes a septum polarizer 302, a pair of diplexers 304, 306, and a wave coupler/splitter 308.

Figure 7:
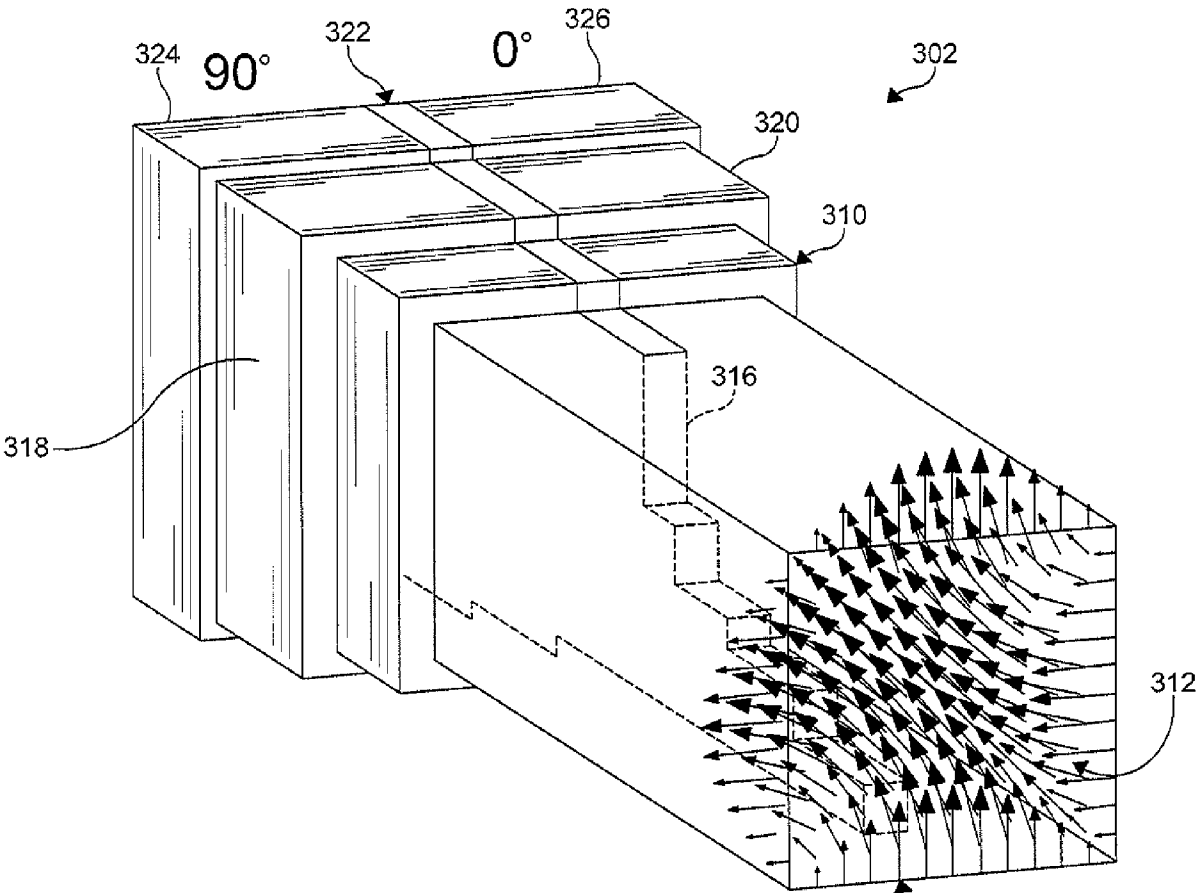
FIG. 7 is a front perspective view of a three dimensional schematic model of a septum polarizer of the antenna feed network of FIG. 6, showing a polarization pattern at a horn of the septum polarizer.
Figure 8:
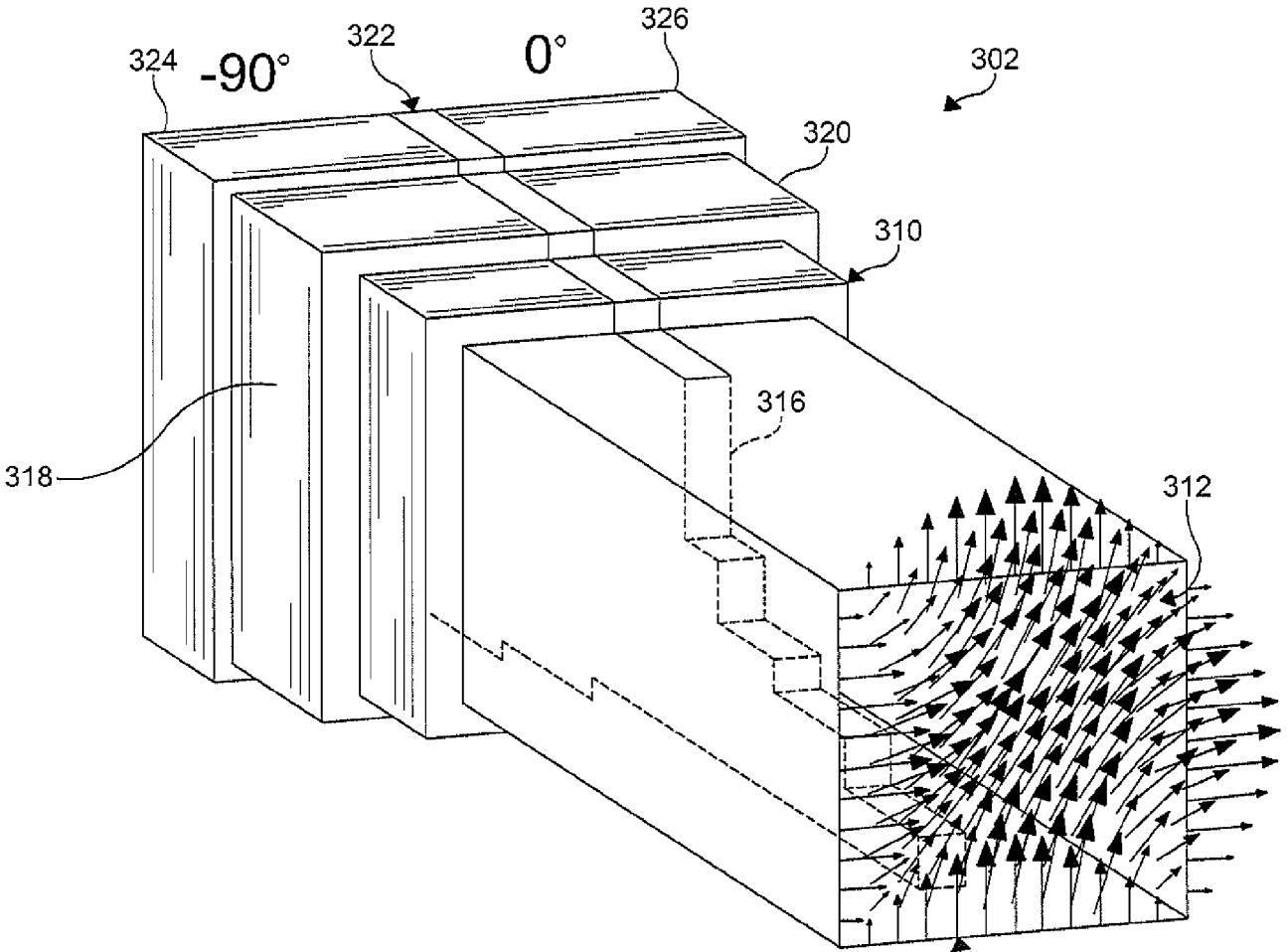
FIG. 8 is a front perspective view of a three dimensional schematic model of a septum polarizer of the antenna feed network of FIG. 6, showing a polarization pattern at a horn of the septum polarizer.

The septum polarizer 302 includes a wave guide 310 defining a cavity 312 therein, as shown in FIGS. 7 and 8. The waveguide 310 includes a horn end 314 to receive and radiate electromagnetic waves in a desired direction. As a non-limiting example, the horn end 314 is an open end. However, the horn end 314 can be enclosed. As further a non-limiting example, the horn end 314 is un-flared and has a substantially square shaped cross-section. It is understood that the wave guide 310 may have one or more expansion curves, i.e. longitudinal cross sections such as elliptical, conical, hyperbolic, or parabolic curves, and not necessarily the same expansion curve in each cross section (i.e. E-plane and H-plane). It is further understood that a wide range of beam patterns may be formed by controlling the dimensions and shape of the waveguide 310 as well as a shape and placement of a reflector (not shown) and a choke (not shown), for example. The waveguide 310 can have any shape, flare, and dimensions.

A septum 316 is disposed in the cavity 312 to split a portion of the cavity 312 into a first waveguide portion 318 and a second waveguide portion 320. As shown, the septum 316 has a stepped configuration to generate circular polarization as can be appreciated by one skilled in the art of antenna feed networks. However, other configurations and shapes can be used.

In the embodiment shown, the septum 316 extends along a center line of the waveguide 310 and bisects a back end 322 of the waveguide 310 opposite the horn end 314 to form two ports 324, 326. As a non-limiting example, the ports 324, 326 can have any size and shape and can be substantially the same or different. Each of the ports 324, 326 is disposed on a respective side of the septum 316 and has a generally rectangular shape. As a non-limiting example, the first port 324 is in signal communication with the first waveguide portion 318 and the second port 326 is in signal communication with the second waveguide portion 320. It is understood that any number of the ports 324, 326 can be used. It is further understood that the ports 324, 326 can have any shape, size and orientation.

The first diplexer 304 includes a common port 328, a first polarizer port 330, and a second polarizer port 332. As shown, the common port 328 is in signal communication with the first port 324 of the septum polarizer 302 for intercommunication of signals therebetween. The first polarizer port 330 has a pre-determined passband frequency and is typically associated with circular polarization. The second polarizer port 332 is in signal communication with the wave coupler/splitter 308. The second polarizer port 332 has a pre-determined passband frequency that is typically different than a bandwidth associated with the first polarizer port 330. It is understood that any passband frequency can be associated with the ports 330, 332. It is further understood that any diplexer can be used such as a waveguide diplexer known in the art.

The second diplexer 306 includes a common port 334, a first polarizer port 336, and a second polarizer port 338. As shown, the common port 334 is in signal communication with the second port 326 of the septum polarizer 302 for intercommunication of signals therebetween. The first polarizer port 336 has a pre-determined passband frequency and is typically associated with circular polarization. The second polarizer port 338 is in signal communication with the wave coupler/splitter 308. The second polarizer port 338 has a pre-determined passband frequency that is typically different than a bandwidth associated with the first polarizer port 336. It is understood that any passband frequency can be associated with the ports 336, 338. It is further understood that any diplexer can be used such as a waveguide diplexer known in the art.

The wavecoupler/splitter 308 is a branch-line coupler having a first signal port 340, a second signal port 342, a first signal path 344, and a second signal path 346. As a non-limiting example, the first signal port 340 is an input port, wherein a signal incident on the first signal port 340 splits equally between the first signal path 344 and the second signal path 346 with the resulting split signals being 90 degrees out-of-phase with the second signal path 346 leading. As a further non-limiting example, the second signal port 342 is an isolated port, wherein a signal incident on the second signal port 342 splits equally between the first signal path 342 and the second signal path 344 with the resulting split signals being 90 degrees out of phase with the first signal path 344 leading. It is understood that other arrangements can be used to vary the phase comparison between a signal transmitted along the first single path 344 and the second signal path 346. It is further understood that other waveguide coupler/splitters can be used to function as a magic-T and a second septum polarizer, as appreciated by one skilled in the art of waveguides.

As shown, the first signal path 344 is in signal communication with the second polarizer port 332 of the first diplexer 304. The second signal path 346 is in signal communication with the second port 338 of the second diplexer 306. However, any signal routing configuration can be used.

In use, a signal is received at the horn end 314 of the waveguide 310 and the septum 316 splits the signal into a left-hand circular polarization (LHCP) component and right-hand circular polarization (RHCP) component. As a non-limiting example, the RHCP component of the signal is received at the port 324 and the LHCP component of the signal is received at the port 326. Each of the ports 324, 326 routes a received component of the signal to the respective common ports 328, 334 of the diplexers 304, 306. Each of the diplexers 304, 306 routes a received component of the signal to at least one of the polarizer ports 330, 332, 336, 338 based on a frequency of the received signal. In certain embodiments, at least a portion of the signal is routed to the wave coupler/splitter 308 through at least one of the second polarizer ports 332, 338 of at least one of the diplexers 304, 306.

In certain embodiments, a linear polarized signal received at the horn end 314 is passed through at least one of the second polarizer port 332, 338 of at least one of the diplexers 304, 306 based upon a pre-determined linear polarization bandwidth. As a non-limiting example, the signal ports 340, 342 are linearly polarized, the polarization of each of the signal ports 340, 342 orthogonal to the other and rotated 45 degrees from the polarizations that would be received using a magic-T waveguide.

The antenna feed network 300 can be used to transmit polarized signals. As a non-limiting example, the first polarizer ports 330, 336 of each of the diplexers 304, 306 can be selectively fed with a signal to transmit a RHCP signal and a LHCP signal at the horn end 314. As a further non-limiting example, each of the signal ports 340, 342 of the wave coupler/splitter 208 can be selectively fed with a signal to transmit a linear polarized signal at the horn end 314. As more clearly shown in FIG. 7, where the first signal port 340 (i.e. input port) of the wave coupler/splitter 308 is fed with a signal, the transmitted signal at the horn end 314 is polarized at 45° from vertical and rotated towards the port 326. As more clearly shown in FIG. 8, where the second signal port 342 (i.e. isolated port) of the wave coupler/splitter 308 is fed with a signal, the transmitted signal at the horn end 314 is polarized at 45° from vertical and rotated towards the port 324.

Figure 9:
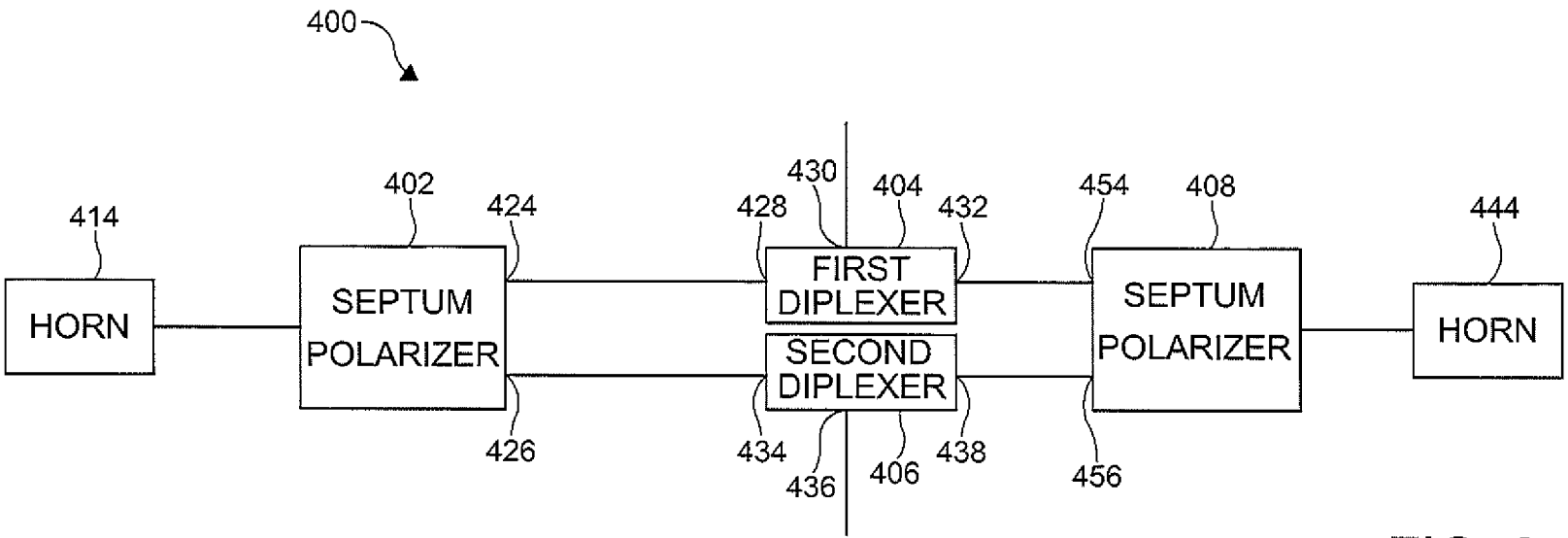
FIG. 9 is a schematic diagram of an antenna feed network according to another embodiment of the present invention.
Figure 10:
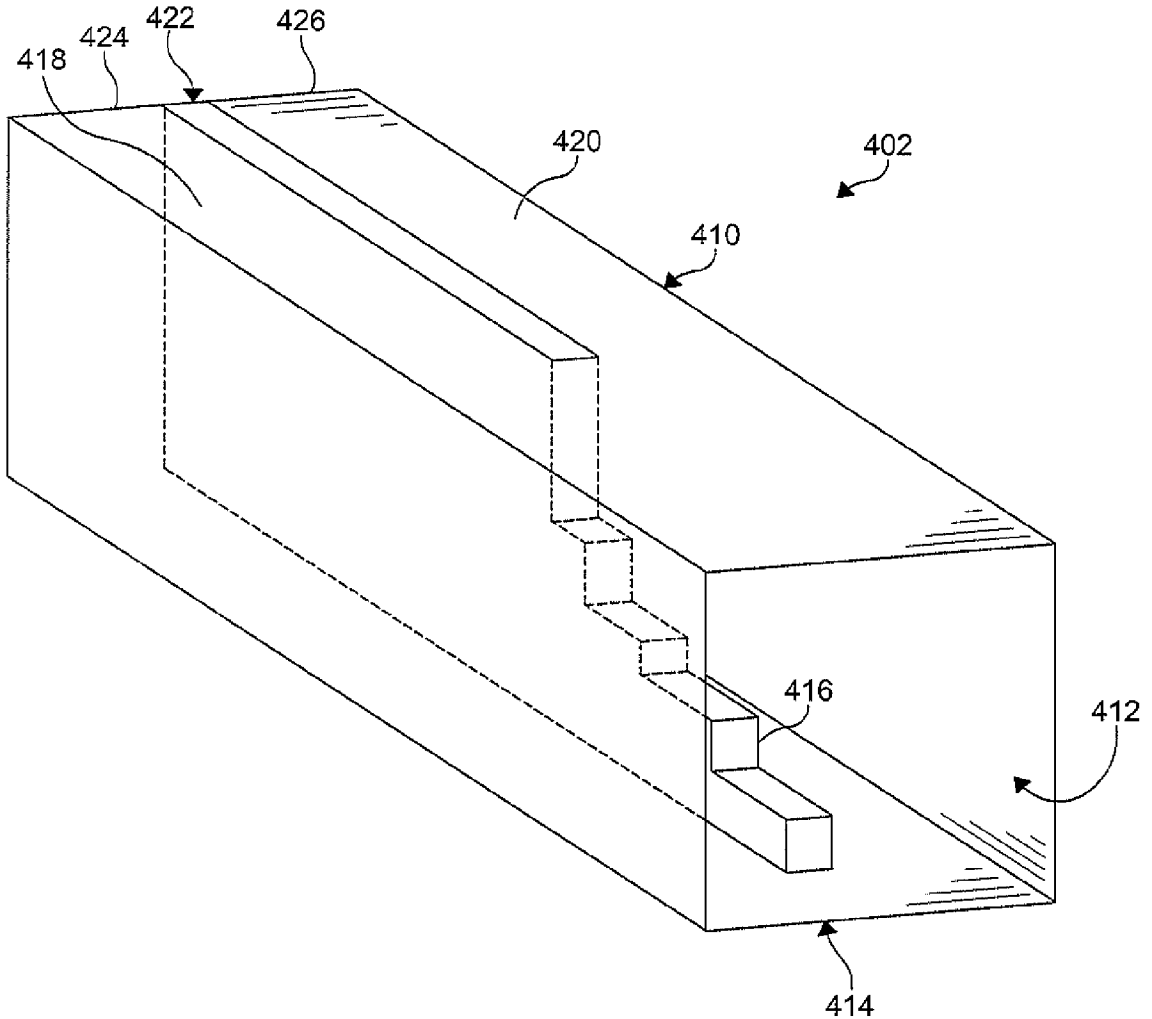
FIG. 10 is a front perspective view of a three dimensional schematic model of a first septum polarizer of the antenna feed network of FIG. 9.
Figure 11:
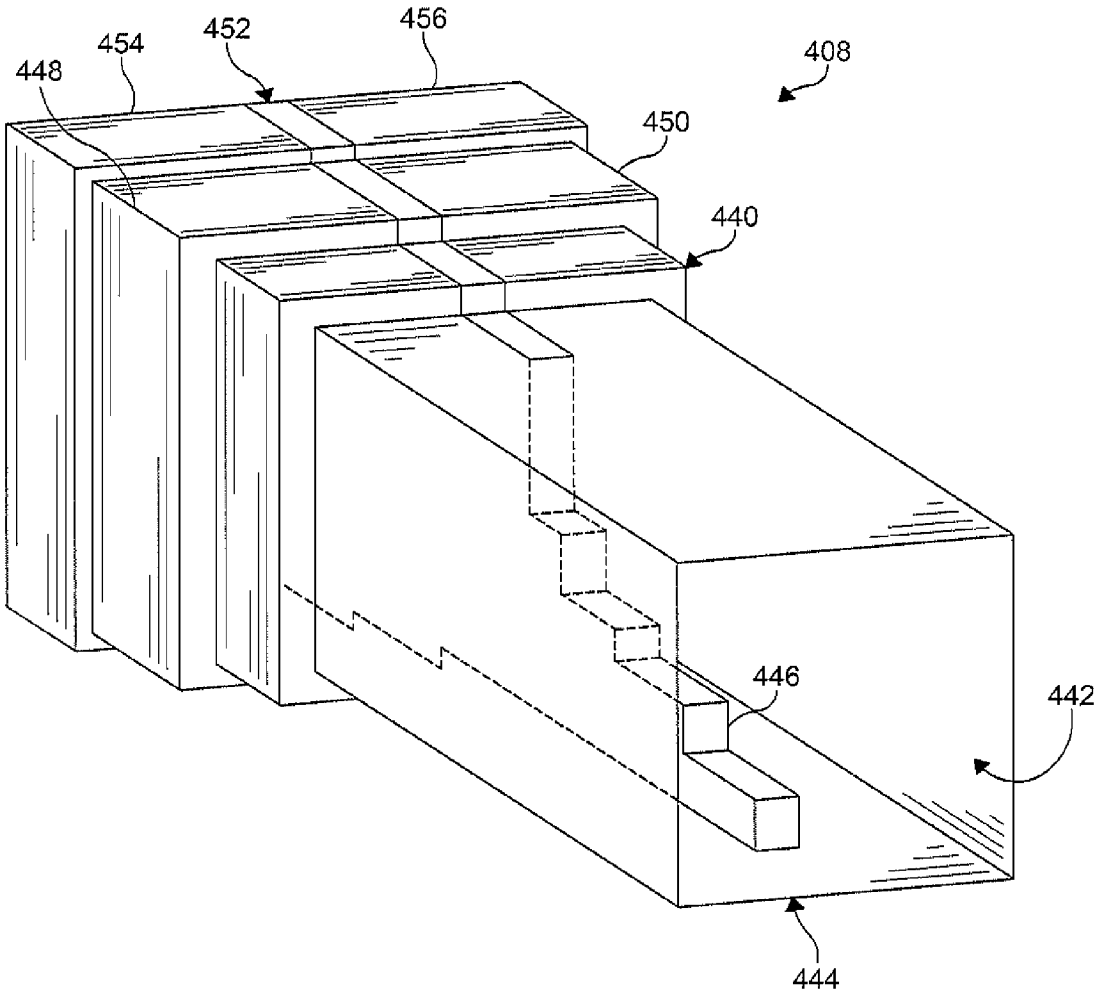
FIG. 11 is a front perspective view of a three dimensional schematic model of a second septum polarizer of the antenna feed network of FIG. 9.

FIGS. 9-11 illustrate an antenna feed network 400 according to an embodiment of the present invention similar to the network 100 except as described herein below. As shown, the network 400 includes a first septum polarizer 402, a pair of diplexers 404, 406, a wave coupler/splitter 408.

As more clearly shown in FIG. 10, the first septum polarizer 402 includes a wave guide 410 defining a cavity 412 therein. As shown, the waveguide 410 has a substantially square cross section. The waveguide 410 includes a horn end 414 to receive and radiate electromagnetic waves in a desired direction. As a non-limiting example, the horn end 414 is an open end. However, the horn end 414 can be enclosed. As further a non-limiting example, the horn end 414 is un-flared and has a substantially square shaped cross-section. It is understood that the wave guide 410 may have one or more expansion curves, i.e. longitudinal cross sections such as elliptical, conical, hyperbolic, or parabolic curves, and not necessarily the same expansion curve in each cross section (i.e. E-plane and H-plane). It is further understood that a wide range of beam patterns may be formed by controlling the dimensions and shape of the waveguide 410 as well as a shape and placement of a reflector (not shown) and a choke (not shown), for example. The waveguide 410 can have any shape, flare, and dimensions.

A septum 416 is disposed in the cavity 412 to split a portion of the cavity 412 into a first waveguide portion 418 and a second waveguide portion 420. As shown, the septum 416 has a stepped configuration to generate circular polarization as can be appreciated by one skilled in the art of antenna feed networks. However, other configurations and shapes can be used.

In the embodiment shown, the septum 416 extends along a center line of the waveguide 410 and bisects a back end 422 of the waveguide 410 opposite the horn end 414 to form two ports 424, 426. As a non-limiting example, the ports 424, 426 can have any size and shape and can be substantially the same or different. Each of the ports 424, 426 is disposed on a respective side of the septum 416 and has a generally rectangular shape. As a non-limiting example, the first port 424 is in signal communication with the first waveguide portion 418 and the second port 426 is in signal communication with the second waveguide portion 420. It is understood that any number of the ports 424, 426 can be used. It is further understood that the ports 424, 426 can have any shape, size and orientation.

The first diplexer 404 includes a common port 428, a first polarizer port 430, and a second polarizer port 432. As shown, the common port 428 is in signal communication with the first port 424 of the septum polarizer 402 for intercommunication of signals therebetween. The first polarizer port 430 has a pre-determined passband frequency and is typically associated with circular polarization. The second polarizer port 432 is in signal communication with the wave coupler/splitter 408. The second polarizer port 432 has a pre-determined passband frequency that is typically different than a bandwidth associated with the first polarizer port 430. It is understood that any passband frequency can be associated with the ports 430, 432. It is further understood that any diplexer can be used such as a waveguide diplexer known in the art.

The second diplexer 406 includes a common port 434, a first polarizer port 436, and a second polarizer port 438. As shown, the common port 434 is in signal communication with the second port 426 of the septum polarizer 402 for intercommunication of signals therebetween. The first polarizer port 436 has a pre-determined passband frequency and is typically associated with circular polarization. The second polarizer port 438 is in signal communication with the wave coupler/splitter 408. The second polarizer port 438 has a pre-determined passband frequency that is typically different than a bandwidth associated with the first polarizer port 436. It is understood that any passband frequency can be associated with the ports 436, 438. It is further understood that any diplexer can be used such as a waveguide diplexer known in the art.

As more clearly shown in FIG. 11, the wave coupler/splitter 408 is a second septum polarizer including a wave guide 440 defining a cavity 442 therein. As shown, the waveguide is tapered. However, the waveguide 440 can have any shape, flare, and dimensions. The waveguide 440 includes a horn end 444 to receive and radiate electromagnetic waves in a desired direction. As a non-limiting example, the horn end 444 is an open end. However, the horn end 444 can be enclosed. As further a non-limiting example, the horn end 444 is un-flared and has a substantially square shaped cross-section. It is understood that the wave guide 440 may have one or more expansion curves, i.e., longitudinal cross sections, such as elliptical, conical, hyperbolic, or parabolic curves, and not necessarily the same expansion curve in each cross section (i.e. E-plane and H-plane). It is further understood that a wide range of beam patterns may be formed by controlling the dimensions and shape of the waveguide 440 as well as a shape and placement of a reflector (not shown) and a choke (not shown), for example.

A septum 446 is disposed in the cavity 442 to split a portion of the cavity 442 into a first waveguide portion 448 (i.e. a first signal path) and a second waveguide portion 450 (i.e. a second signal path). As shown, the septum 446 has a stepped configuration to generate circular polarization as can be appreciated by one skilled in the art of antenna feed networks. It is understood that other configurations can be used.

In the embodiment shown, the septum 446 extends along a center line of the waveguide 440 and bisects a back end 452 of the waveguide 440 opposite the horn end 444 to form two ports 454, 456. As a non-limiting example, the ports 454, 456 can have any size and shape and can be substantially the same or different. Each of the ports 454, 456 is disposed on a respective side of the septum 446 and has a generally rectangular shape. As a non-limiting example, the first port 454 is in signal communication with the first waveguide portion 448 and the second port 456 is in signal communication with the second waveguide portion 450. It is understood that any number of the ports 454, 456 can be used. It is further understood that the ports 454, 456 can have any shape, size and orientation.

As shown, the port 454 is in signal communication with the second polarizer port 432 of the first diplexer 404. The port 456 is in signal communication with the second port 438 of the second diplexer 406. However, any signal routing configuration can be used.

In use, a signal is received at the horn end 414 of the waveguide 410 and the septum 416 splits the signal into a left-hand circular polarization (LHCP) component and right-hand circular polarization (RHCP) component. As a non-limiting example, the RHCP component of the signal is received at the port 424 and the LHCP component of the signal is received at the port 426. Each of the ports 424, 426 routes a received component of the signal to the respective common ports 428, 434 of the diplexers 404, 406. Each of the diplexers 404, 406 routes a received component of the signal to at least one of the polarizer ports 430, 432, 436, 438 based on a frequency of the received signal. In certain embodiments, at least a portion of the signal is routed to the wave coupler/splitter 408 through at least one of the second polarizer ports 432, 438 of at least one of the diplexers 404, 406.

In certain embodiments, a linear polarized signal received at the horn end 414 is passed through at least one of the second polarizer ports 432, 438 of at least one of the diplexers 404, 406 based upon a pre-determined linear polarization bandwidth. As a non-limiting example, the horn end 444 of the wave coupler/splitter 408 is linearly polarized.

The antenna feed network 400 can be used to transmit polarized signals. As a non-limiting example, the first polarizer ports 430, 436 of each of the diplexers 404, 406 can be selectively fed with a signal to transmit a RHCP signal and a LHCP signal at the horn end 414. As a further non-limiting example, the horn end 444 of the wave coupler/splitter 408 can be selectively fed with a signal to transmit a linear polarized signal at the horn end 414 of the first septum polarizer 402.

The antenna feed networks 100, 200, 300, 400 provide a compact and light weight solution to an application requiring the capability of both linear and circular polarization.

It is understood that the antenna feed networks 100, 200, 300, 400 can be operated as an independent antenna or as a feed for a reflector system. The reflector system can be a parabolic reflector, a shaped reflector or any other surface requiring to be illuminated by the feed system. In addition, those familiar with the art will understand that the feed can also be used in (but not limited to) other antenna configurations such as the Cassegrain, Gregorian or a multitude of other systems.

It is further understood that in certain embodiments, the antenna feed networks 100, 200, 300, 400 uses a corrugated feed horn. Those familiar with the art will understand that the feed horn can be of any kind and not limited to the one described herein. The other types of feed horn which can be used are, for example, (but not limited to) potter horns, broad band horns, multimode horns of several types, horns with stepped junctions, horns with sloped or profiled walls and horns utilizing meta-materials. The antenna feed can be used with any radiating horn which has the required RF bandwidth compatible with the bandwidth of the antenna feed described.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. An antenna feed network comprising:

a septum polarizer including a waveguide defining a cavity, wherein a septum is disposed in the cavity to divide the cavity to form a first port and a second port, and wherein the septum has a stepped configuration;

a diplexer in signal communication with at least one of the first port and the second port of the septum polarizer to route a signal based upon a frequency; and a wave coupler/splitter in signal communication with the diplexer to send and receive signals therebetween, the wave coupler/splitter including a first signal path and a second signal path, wherein the wave coupler/splitter controls a phase shift of a signal transmitted through at least one of the first signal path and the second signal path.

2. The antenna feed network according to claim 1, wherein the waveguide of the septum polarizer is tapered.

3. The antenna feed network according to claim 1, wherein the diplexer includes a common port in signal communication with at least one of the first port and the second port of the septum polarizer, a first polarizer port having a first pre-determined passband frequency, and a second polarizer port having a second pre-determined passband frequency.

4. The antenna feed network according to claim 3, wherein the first passband frequency is in a pre-determined circular polarization band.

5. The antenna feed network according to claim 3, wherein the second passband frequency is in a pre-determined linear polarization band.

6. The antenna feed network according to claim 1, wherein the wave coupler/splitter includes a variable phase shifter in signal communication with at least one of the first signal path and the second signal path to control a phase shift of a signal transmitted therethrough.

7. The antenna feed network according to claim 1, wherein the wave coupler/splitter is a magic-T wave guide.

8. The antenna feed network according to claim 1, wherein the wave coupler/splitter is a branch-line coupler.

9. The antenna feed network according to claim 1, wherein the wave coupler/splitter is a second septum polarizer having a waveguide defining a cavity and a septum dividing the cavity.

10. The antenna feed network according to claim 9, wherein the waveguide of the second septum polarizer is tapered.

11. An antenna feed network comprising:

a septum polarizer including a waveguide defining a cavity, wherein a septum is disposed in the cavity to divide the cavity to form a first port and a second port, the septum having a stepped configuration;

a first diplexer in signal communication with the first port of the septum polarizer to route a signal based upon a frequency;

a second diplexer in signal communication with the second port of the septum polarizer to route a signal based upon a frequency; and a wave coupler/splitter in signal communication with the diplexer to send and receive signals therebetween, the wave coupler/splitter including a first signal path and a second signal path, wherein the wave coupler/splitter controls a phase shift of a signal transmitted through at least one of the first signal path and the second signal path.

12. The antenna feed network according to claim 11, wherein the first diplexer includes a common port in signal communication with the first port of the septum polarizer, a first polarizer port having a first pre-determined passband frequency, and a second polarizer port having a second pre-determined passband frequency.

13. The antenna feed network according to claim 11, wherein the second diplexer includes a common port in signal communication with the second port of the septum polarizer, a first polarizer port having a first pre-determined passband frequency, and a second polarizer port having a second pre-determined passband frequency.

14. The antenna feed network according to claim 11, wherein the wave coupler/splitter is a magic-T wave guide.

15. The antenna feed network according to claim 11, wherein the wave coupler/splitter is a branch-line coupler.

16. The antenna feed network according to claim 11, wherein the wave coupler/splitter is a second septum polarizer having a waveguide defining a cavity and a septum dividing the cavity.

17. An antenna feed network comprising:

a septum polarizer including a waveguide defining a cavity, wherein a septum having a stepped configuration is disposed in the cavity to divide the cavity to form a first port and a second port;

a first diplexer including a common port in signal communication with the first port of the septum polarizer to route a signal based upon a frequency, wherein first diplexer further includes a first polarizer port having a first pre-determined passband frequency and a second polarizer port having a second pre-determined passband frequency, each of the first polarizer port and the second polarizer port of the first diplexer in signal communication with the first port of the septum polarizer;

a second diplexer including a common port in signal communication with the second port of the septum polarizer to route a signal based upon a frequency, wherein second diplexer further includes a first polarizer port having a first pre-determined passband frequency and a second polarizer port having a second pre-determined passband frequency, each of the first polarizer port and the second polarizer port of the second diplexer in signal communication with the second port of the septum polarizer; and a wave coupler/splitter in signal communication with the diplexer to send and receive signals therebetween, the wave coupler/splitter including a first signal path and a second signal path, wherein the wave coupler/splitter controls a phase shift of a signal transmitted through at least one of the first signal path and the second signal path.

18. The antenna feed network according to claim 17, wherein the first passband frequency of the first diplexer is in a pre-determined circular polarization band and the second passband frequency of the first diplexer is in a pre-determined linear band.

19. The antenna feed network according to claim 17, wherein the first passband frequency of the second diplexer is in a pre-determined circular polarization band and the second passband frequency of the second diplexer is in a pre-determined linear band.

* * * * *

UNITED STATES PATENT AND TRADEMARK OFFICE

CERTIFICATE OF CORRECTION

PATENT NO. : 8,525,616 B1
APPLICATION NO. : 12/758429
DATED : September 3, 2013
INVENTOR(S) : Robert K. Shaw et al.

It is certified that error appears in the above-identified patent and that said Letters Patent is hereby corrected as shown below:

Title Page

Please correct the name listed in (75) Inventors from "Sulinder S. Dhanjal" to "Sutinder S. Dhanjal".

Signed and Sealed this
Twenty-second Day of October, 2013

Teresa Stanek Rea

Teresa Stanek Rea
*Deputy Director of the United States Patent and Trademark Office*